US011337570B2

(12) United States Patent
Leffler et al.

(10) Patent No.: US 11,337,570 B2
(45) Date of Patent: May 24, 2022

(54) STICK VACUUM CLEANER WITH IMPROVED FILTER

(71) Applicant: Aktiebolaget Electrolux, Stockholm (SE)

(72) Inventors: Jens Leffler, Stockholm (SE); Maeva Schaller, Stockholm (SE); Christian Ågren, Stockholm (SE); Håkan Miefalk, Stockholm (SE)

(73) Assignee: Aktiebolaget Electrolux

( * ) Notice: Subject to any disclaimer, the term of this patent is extended or adjusted under 35 U.S.C. 154(b) by 239 days.

(21) Appl. No.: 16/336,166

(22) PCT Filed: Oct. 7, 2016

(86) PCT No.: PCT/EP2016/074053

§ 371 (c)(1),
(2) Date: Mar. 25, 2019

(87) PCT Pub. No.: WO2018/065068

PCT Pub. Date: Apr. 12, 2018

(65) Prior Publication Data

US 2019/0223668 A1 Jul. 25, 2019

(51) Int. Cl.

| | |
|---|---|
| ***A47L 5/24*** | (2006.01) |
| ***A47L 5/22*** | (2006.01) |
| ***A47L 9/16*** | (2006.01) |

(52) U.S. Cl.

CPC ..... *A47L 5/24* (2013.01); *A47L 5/225* (2013.01); *A47L 9/1666* (2013.01)

(58) Field of Classification Search

CPC ... A47L 5/24; A47L 5/28; A47L 5/225; A47L 9/00; A47L 9/10; A47L 9/12; A47L 9/14; A47L 9/1658; A47L 9/1666; A47L 9/122; A47L 11/4027

USPC ..... 15/329

See application file for complete search history.

(56) References Cited

U.S. PATENT DOCUMENTS

| | | | | |
|---|---|---|---|---|
| 4,766,638 | A | 8/1988 | McDowell | |
| 4,967,443 | A | 11/1990 | Krasznai et al. | |
| 7,572,307 | B2 | 8/2009 | Coburn | |
| 8,671,510 | B2 * | 3/2014 | Han | A47L 5/24 15/329 |

(Continued)

FOREIGN PATENT DOCUMENTS

| | | | |
|---|---|---|---|
| CN | 1653999 | A | 8/2005 |
| CN | 1768660 | A | 5/2006 |

(Continued)

OTHER PUBLICATIONS

Chinese Office Action for Chinese Application No. 201680089784.7, dated Aug. 27, 2020, 8 pages.

(Continued)

*Primary Examiner* — Joseph J Hail
*Assistant Examiner* — Timothy Brady
(74) *Attorney, Agent, or Firm* — RatnerPrestia

(57) ABSTRACT

The invention relates to a stick vacuum cleaner comprising a handheld vacuum cleaner adapted to be docked to a stick. When the handheld vacuum cleaner is docked to the stick an air path is formed connecting an air outlet of the handheld vacuum cleaner with an air outlet provided in the stick. In the air path or outside the air outlet provided in the stick, a filter is provided.

5 Claims, 5 Drawing Sheets

(56) References Cited

U.S. PATENT DOCUMENTS

| | | | | |
|---|---|---|---|---|
| 9,622,630 | B2 * | 4/2017 | Faremo | A47L 5/28 |
| 9,962,046 | B2 | 5/2018 | Rowntree | |
| 10,182,690 | B2 * | 1/2019 | Tan | A47L 5/14 |
| 10,413,142 | B2 * | 9/2019 | Hwang | A47L 9/0054 |
| 2005/0011038 | A1 * | 1/2005 | Coburn | A47L 9/122 15/344 |
| 2005/0071946 | A1 * | 4/2005 | Hafling | A47L 9/1409 15/352 |
| 2006/0174597 | A1 * | 8/2006 | Greene | A47L 9/122 55/482 |
| 2008/0040883 | A1 * | 2/2008 | Beskow | A47L 9/165 15/329 |
| 2008/0172992 | A1 * | 7/2008 | Conrad | A47L 9/1625 55/323 |
| 2012/0124770 | A1 * | 5/2012 | Engstrom | A47L 5/28 15/328 |
| 2014/0082882 | A1 * | 3/2014 | Kawamata | A47L 5/24 15/330 |
| 2015/0135470 | A1 * | 5/2015 | Mantyla | A47L 9/2873 15/301 |
| 2015/0250370 | A1 * | 9/2015 | Fan | A47L 5/28 15/353 |
| 2015/0289733 | A1 * | 10/2015 | Rowntree | A47L 5/28 15/329 |
| 2016/0037984 | A1 * | 2/2016 | Park | F04D 25/08 15/326 |
| 2016/0106285 | A1 * | 4/2016 | Jenson | A47L 5/28 29/426.1 |
| 2018/0147522 | A1 * | 5/2018 | Wada | B01D 69/12 |
| 2018/0333019 | A1 * | 11/2018 | Wang | A47L 5/24 |

FOREIGN PATENT DOCUMENTS

| | | | |
|---|---|---|---|
| CN | 205379271 | U | 7/2016 |
| EP | 2929820 | A1 | 10/2015 |
| JP | 55156639 | U | 11/1980 |
| JP | 57194447 | U | 12/1982 |
| JP | 6348546 | U | 4/1988 |
| JP | 0355020 | A | 3/1991 |
| JP | 2015202410 | A | 11/2015 |
| WO | 2004069021 | A1 | 8/2004 |
| WO | 2008088278 | A2 | 7/2008 |

OTHER PUBLICATIONS

Japanese Notice of Reasons for Refusal for Japanese Application No. 2019-510452, dated Oct. 2, 2020, 5 pages.

International Search Report and Written Opinion for International Application No. PCT/EP2016-074053 dated Jul. 6, 2017, 9 pages.

* cited by examiner

STICK VACUUM CLEANER WITH IMPROVED FILTER

This application is a U.S. National Phase application of PCT International Application No. PCT/EP2016/074053, filed Oct. 7, 2016, which is incorporated by reference herein.

TECHNICAL FIELD

The invention relates to a vacuum cleaner. In particular the invention relates to a stick vacuum cleaner.

BACKGROUND

Hand held vacuum cleaners which are battery powered as well as powered by mains supply, are previously known, see for instance U.S. Pat. No. 4,967,443, and are used for fast cleaning of small surfaces. It is important that such vacuum cleaners are easily accessible and user friendly designed. These vacuum cleaners are usually designed such that the dust container together with the filter can be removed from the remaining part of the vacuum cleaner housing that contains the fan unit.

It is also previously known to use the type of hand held vacuum cleaner described above in combination with a shaft part whose, lower portion supports a nozzle. This type of hand held vacuum cleaner can be referred to as a stick vacuum cleaner or a 2-in-1 stick vacuum cleaner, see for instance WO 2004/069021. The shaft part is provided with a tube connection by means of which dust laden air is transferred from the nozzle to the air inlet of the hand held vacuum cleaner which is removably secured to the shaft part. This means that the combined stick vacuum cleaner in a comfortable way can be used for floor cleaning purpose. In other words, the handheld stick vacuum cleaner can be docked and undocked to/from the stick to allow for floor cleaning when the hand held vacuum cleaner is docked to the stick. Another conventional stick vacuum cleaner is described in WO2008/088278.

In a conventional stick vacuum cleaner there are strict space requirements. This reduces the possibilities to provide components requiring a large space in the stick vacuum cleaner resulting to worse performance in some aspects compared to conventional vacuum cleaners because some conventional components may have to be omitted or replaced with a less efficient component in a handheld vacuum cleaner. There is a constant desire to improve the performance of vacuum cleaners. Hence there is a need for an improved stick vacuum cleaner.

SUMMARY

It is an object of the present invention to provide an improved vacuum cleaners. In particular it is an object of the present invention to provide an improved stick vacuum cleaner.

This object is obtained by the stick vacuum cleaner as set out in the appended claims.

In accordance with one embodiment a stick vacuum cleaner comprising a handheld vacuum cleaner adapted to be docked to a stick is provided. When the handheld vacuum cleaner is docked to the stick an air path is formed connecting an air outlet of the handheld vacuum cleaner with an air outlet provided in the stick. A filter is provided in the air path. Hereby it is achieved that an improved filtering can be provided when the stick vacuum cleaner is in a docked mode where the handheld vacuum cleaner is docked to the stick, at least when the handheld vacuum cleaner is in a docked mode of operation. The filter can as an alternative or as a supplement be provided on the outside of the stick at the air outlet from the stick.

In accordance with one embodiment an air tight sealing is provided at the air inlet in the stick or at the air outlet from the handheld vacuum cleaner. An air tight sealing can also be provided both at the air inlet in the stick and at the air outlet.

In accordance with one embodiment a release mechanism is provided for releasing the filter from the stick.

In accordance with one embodiment the filter comprises, a pleated filter media.

The invention also extends to a stick for a stick vacuum cleaner in accordance with the above.

BRIEF DESCRIPTION OF THE DRAWINGS

The invention will now be described in more detail, way of example and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
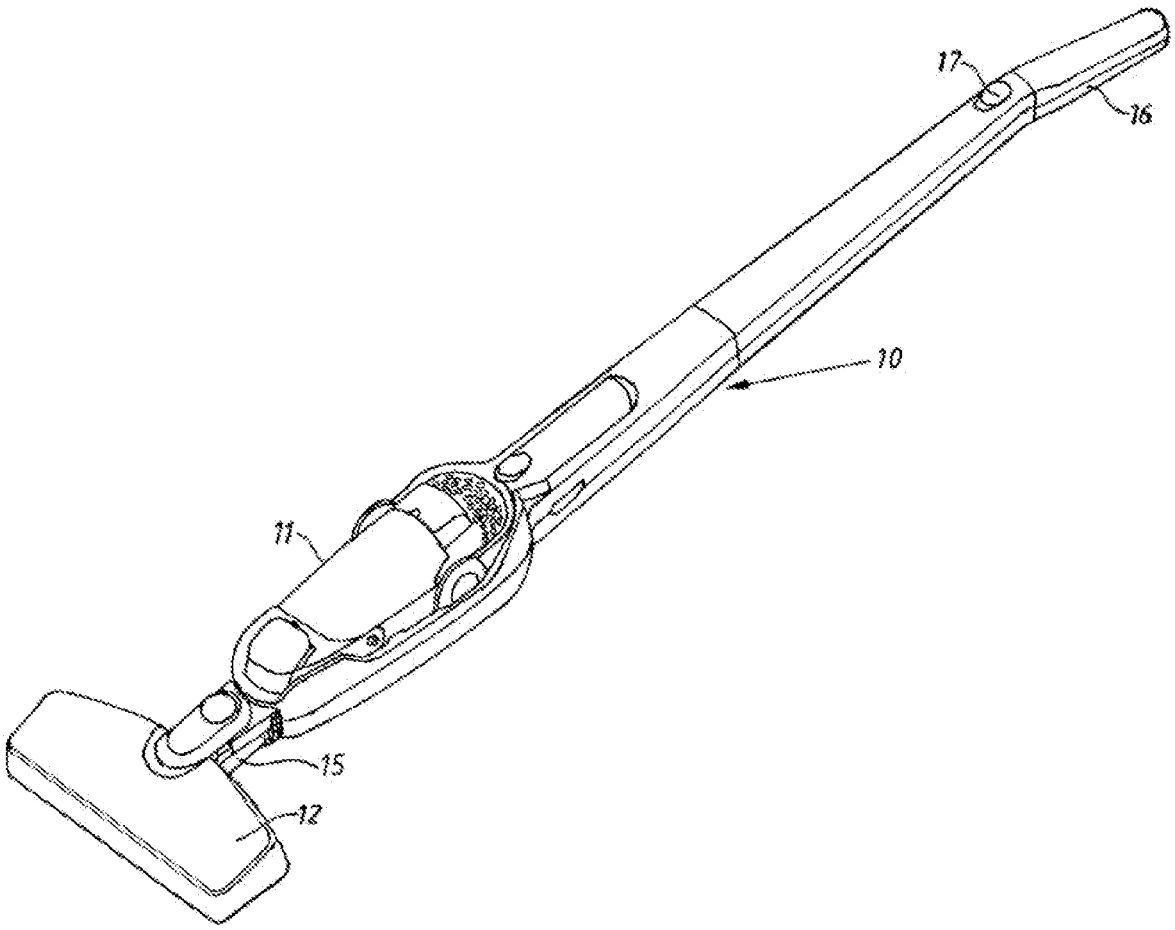
FIG. 1 shows a stick vacuum cleaner according to the prior art.

FIG. 1 schematically shows a conventional stick vacuum cleaner 10 according to the prior art. The shown stick vacuum cleaner 10 comprises an elongated shaft part. The elongated shaft part can be referred to as the stick. In the stick a hand held vacuum cleaner 11 is removably arranged. Thus, the hand held vacuum cleaner 11 can thereby be docked and un-docked to/from the stick. The lower (front) end of the stick supports a floor nozzle 12 that can be turnably secured to the stick. The nozzle 12 has an elongated suction opening and the suction opening is via a passage 15 connected to the hand held vacuum cleaner 11 in a conventional manner. The upper (rear) portion of the stick can be shaped as a handle 16 and typically has an operating knob 17 that via an electric circuit, not shown in detail, is connected to the hand held vacuum cleaner 11 when it is docked to the stick.

A problem associated with a stick vacuum cleaner such as the one depicted, in FIG. 1 is that there are strict space limitations for providing devices inside the handheld vacuum cleaner 11. This is because there are typically strict requirements as to the size and weight of the handheld vacuum cleaner to not make it bulky and difficult to operate. As a result, some elements usually found in a conventional vacuum cleaner are typically omitted or made very small in the handheld vacuum cleaner 11. For example, it has been realized that there is room for improvement of the filtering of the outlet air provided in the handheld vacuum cleaner.

In order to at least partly solve or reduce this problem, a filter can be located in the stick in an air passage way from the outlet from the air outlet of the handheld vacuum cleaner 11 to the air outlet from the stick. Hereby it is achieved that an improved filtering can be provided when the stick vacuum cleaner is in a docked mode where the handheld vacuum cleaner is docked to the stick. The filter can as an alternative or as a supplement be provided on the outside of the stick at the air outlet from the stick.

Figure 2:
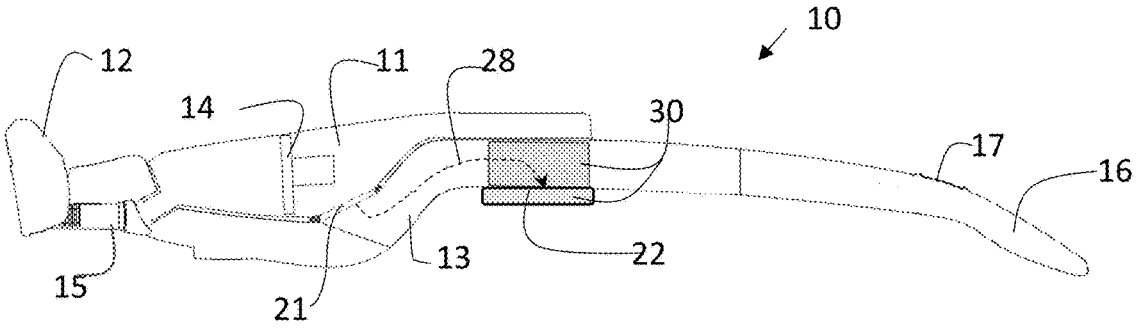
FIG. 2 shows a sectional view of a stick vacuum cleaner.

In FIG. 2 a sectional view from the side of a stick vacuum cleaner 10 is shown. In FIG. 2 a stick 13 of the stick vacuum cleaner 10 is provided with a filter 30. The filter 30 can be located in the air path from the handheld vacuum cleaner 11 in the stick 13. Thus, the filter 30 can be located in the air path from the air outlet 21 of the handheld vacuum cleaner 11 to an air outlet 22 from the stick 13. The air path is in FIG. 2 illustrated by the arrow 28. When in use, a motor 14 of the handheld vacuum cleaner 11 draws air from a nozzle 12 via an air passage 15 and out from the handheld vacuum cleaner 11 via the air outlet 21. If the handheld vacuum cleaner 11 is docked to the stick 13 the air flow continues via the air path to the air outlet 22 in the stick 13.

In order to make the filtering efficient an air tight sealing can be provided at the air inlet in the stick or the air outlet 21 from the handheld vacuum cleaner or both.

Further, in FIG. 2 the filter 30 is shown as directly connecting the air outlet 21 with the air outlet 22. However, it is also envisaged that an air path 28 is provided inside the stick directing outlet air from the handheld vacuum cleaner to an air outlet provided in the stick. Such an air path 28 can be designed in any suitable manner. Further, the filter 30 can as an alternative or as a supplement be provided on the outside of the stick at the air outlet 22 from the stick. In such an embodiment the filter can be easily accessed, but the outer dimensions of the stick will typically increase somewhat.

Figure 3A:
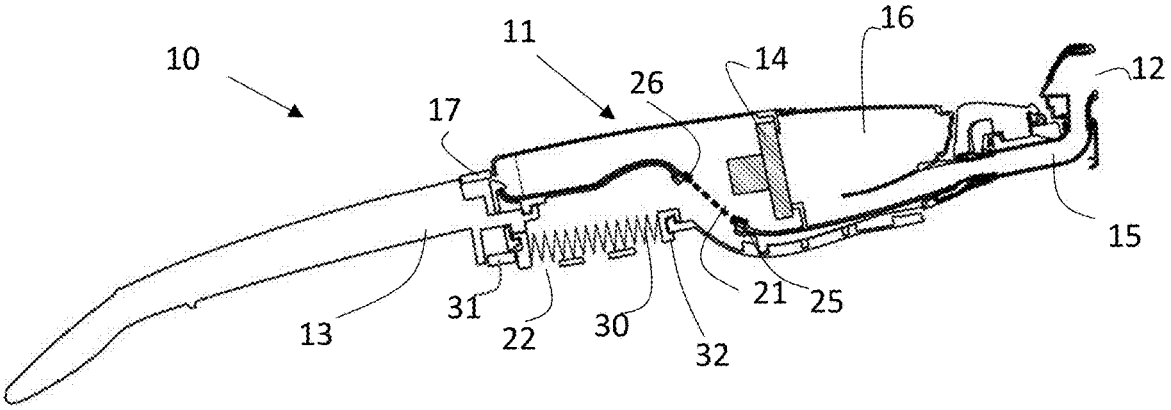
FIGS. 3*a*-3*c* show a stick vacuum cleaner and parts thereof in accordance with one embodiment of the invention.

In FIG. 3*a* a detailed sectional view of a stick vacuum cleaner 10 in accordance with one embodiment is shown. In FIG. 3*a*, the stick 13 comprises a first release mechanism 31 for the filter 30. The release mechanism 31 is adapted to keep the filter in place and to release the filter 30 when manipulated by a user. The release mechanism 31 can be of any conventional design. Further the filter 30 can be fitted in a hook 32 opposite to the release mechanism 31 holding the filter 32 in place. The stick 13 can further comprise a second release mechanism 17 for releasing the handheld vacuum cleaner 11 from the stick 13.

The hand held vacuum cleaner 11 can comprise a first sealing member 25 provided at a front end of the hand held vacuum cleaner 11 to form a sealing to the stick 13 at the air passage 15. Further a second sealing member 26 can be provided at a rear end of the vacuum cleaner to form a sealing at the air outlet 21 from the hand held vacuum cleaner 11. The sealing members 25 and 26 can either be provided in the stick 13 or in the hand held vacuum cleaner 11 or both in the stick 13 and in the hand held vacuum cleaner 11. As is seen in FIG. 3*a* the hand held vacuum cleaner also comprises a dust cup 16 for holding laden dust. Housed in the dust cup 16 there is typically a separator such as a cyclonic separator and typically also some filters.

Figure 3B:
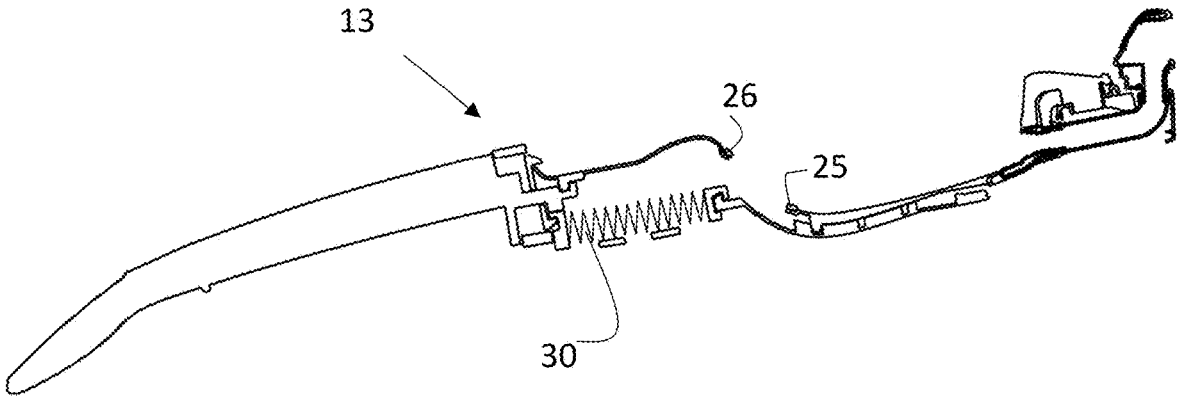

In FIG. 3*b*, the stick 13 with the hand held vacuum cleaner 11 undocked and removed from the stick vacuum cleaner is shown. In the embodiment of FIG. 3*b* the sealing members 25 and 26 are provided in the stick 13. In case the air-tight sealings are provided on the handheld vacuum cleaner, surfaces adapted to cooperate with the air-tight sealings of the hand held vacuum cleaner can be provided on the stick 13.

The sealing members 25 and 26 can be U-shaped sealing or in some instances V-shaped sealing. Such a sealing will provide an air tight connection to the stick. In accordance with another embodiment the sealing is a lip sealing.

Figure 3C:
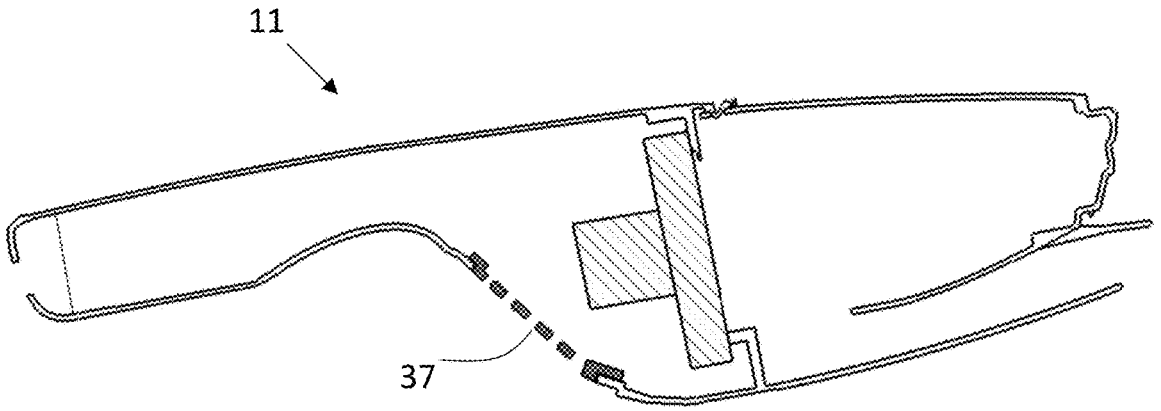

In FIG. 3*c*, the hand held vacuum cleaner 11 undocked and removed from the stick vacuum cleaner is shown. As is seen in FIG. 3*c* the hand held vacuum cleaner 11 can comprise a cover 37. The cover 37 is arranged at the outlet 21.

When the handheld vacuum cleaner 11 is used without the stick 13, the air outlet 21 on the handheld vacuum cleaner 11 is preferably not wide open. There can to be a perforated cover/grill 37 so that the user cannot access the interior of the handheld vacuum cleaner 11 with his/her hands. This perforated cover/grill 37 could be fixed or alternatively could be completely or partly removed from the air path when the handheld vacuum cleaner is docked on the stick in order to reduce losses. In accordance with one embodiment the cover 37 can be spring loaded and be pushed in by a detail on the stick 13 when docked thereto to open the air path and come back into place when undocked.

Figure 4A:
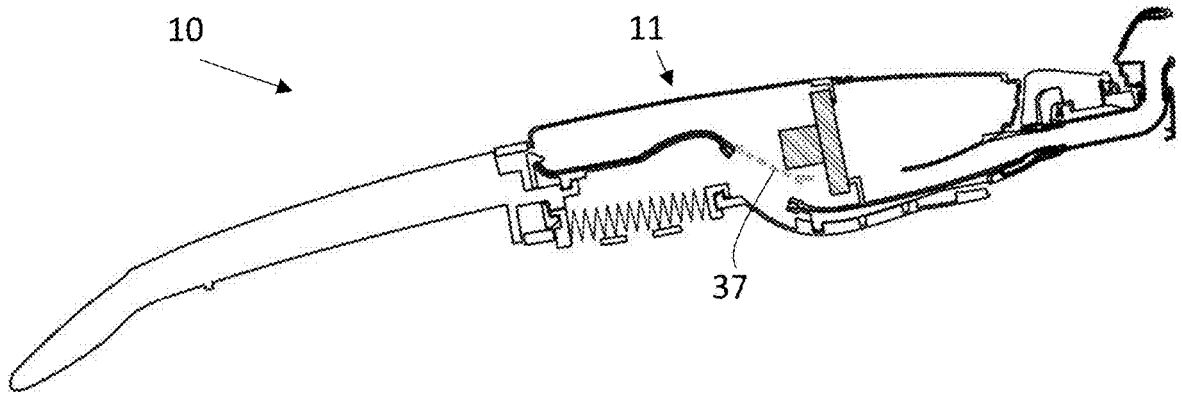
FIGS. 4*a*-4*b* show different embodiments of handheld vacuum cleaner or a stick vacuum cleaner.

In FIG. 4*a*, the hand held vacuum cleaner 11 is shown comprising a cover 37 that is pivotable to be opened when the hand held vacuum cleaner 11 is docked to the stick 13.

Figure 4B:
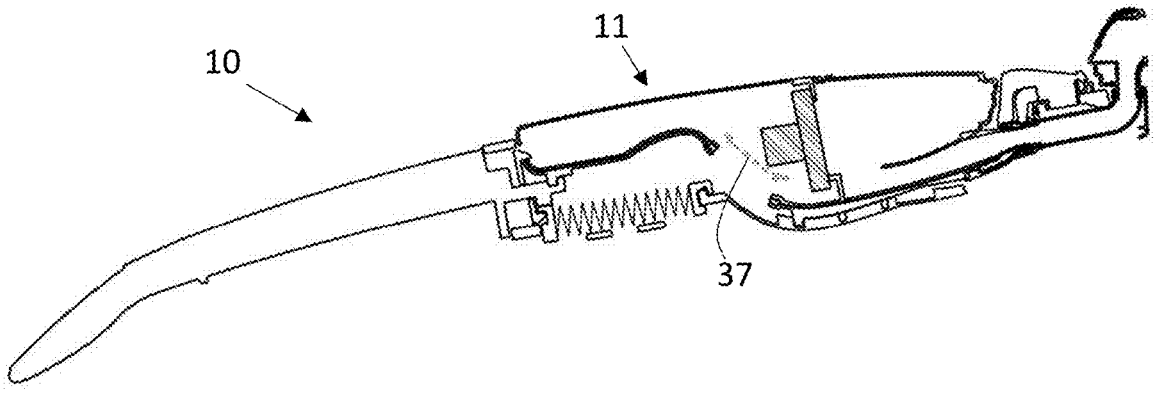

In FIG. 4*b*, the hand held vacuum cleaner 11 is shown comprising a cover 37 that is possible to be pushed to be opened when the hand held vacuum cleaner 11 is docked to the stick 13.

Figure 5:
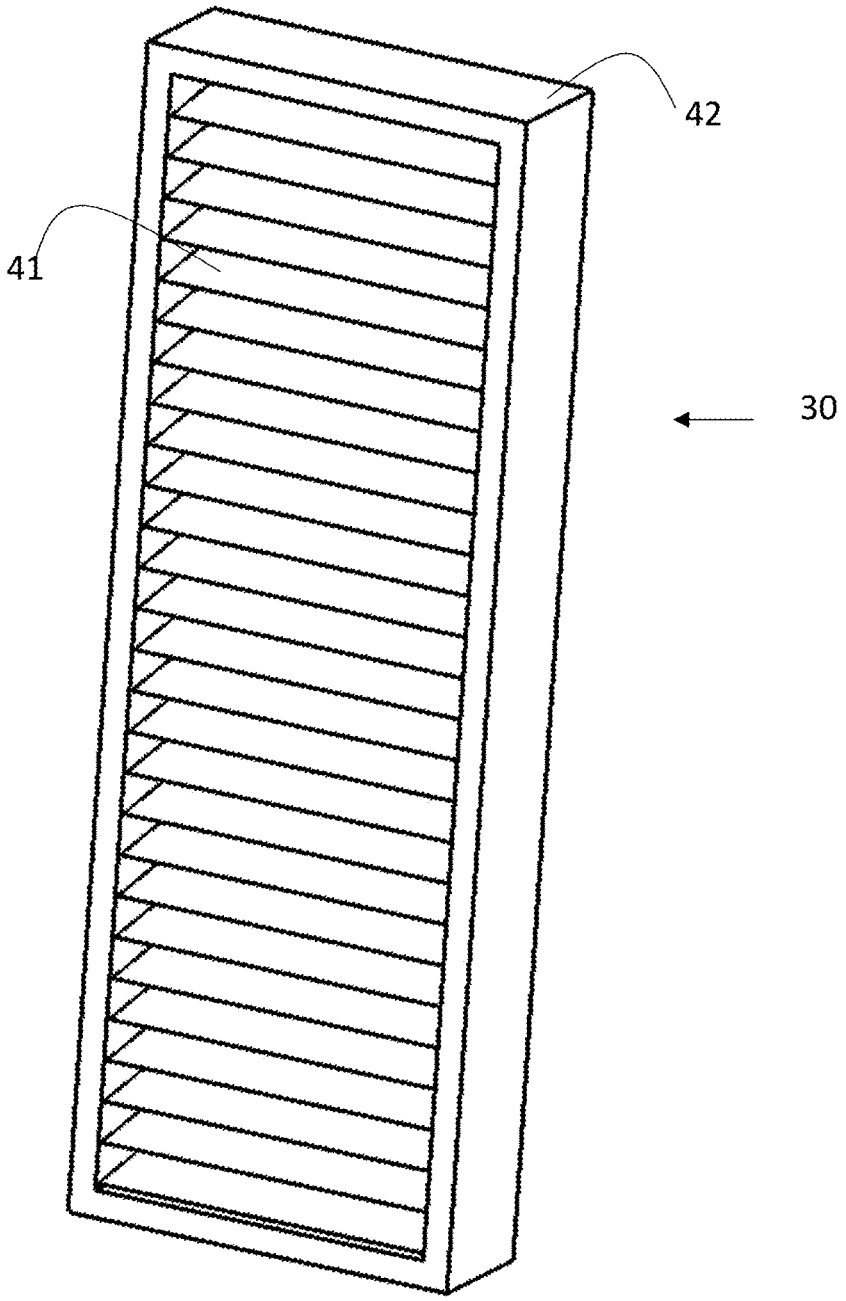
FIG. 5 shows a filter.

In FIG. 5, a filter 30 for a hand held vacuum cleaner 11 is shown. The filter 30 can comprise a filter media 41 mounted on a frame 42, in particular a plastic or rubber frame 42. The frame 42 can have any suitable shape, such as rectangular, oval, round, etc. The filter media 41 can be pleated. The filter media can be formed by foams, composite filter, progressive layer filters, etc.

The filter 30 can be removed from the stick 13 by the user for maintenance or replacement. In accordance with one embodiment, the filter 30 is removed from the stick 13 by providing a lock mechanism on one side and a hook on the other side as is shown in FIG. 3*a*. The user hooks the filter 30 and pushes it in until the mechanism 31 grabs the filter 30. In an alternative embodiment the filter 30 can be secured behind a cover that is removable to access the filter 30.

The invention has been described above with reference to a few embodiments. However, as is readily appreciated by a person skilled in the art, other embodiments than the ones disclosed above are equally possible within the scope of the invention, as defined by the appended claims.

The invention claimed is:

1. A vacuum cleaner system comprising:

a handheld vacuum cleaner having a first air outlet and a perforated cover, the perforated cover being movable between a first position in which the perforated cover is located over the first air outlet such that air exiting the first opening passes through the perforated cover, and a second position in which the perforated cover is displaced, into a body of the handheld vacuum cleaner, from the first air outlet such that air can exit the first opening without passing through the perforated cover;

a stick configured to selectively connect with the handheld vacuum cleaner to form a stick vacuum cleaner, the stick comprising a second air outlet, wherein the handheld vacuum cleaner and stick form an air path connecting the first air outlet to the second air outlet when the handheld vacuum cleaner is connected to the stick; and at least one filter located in the air path or covering the second air outlet.

2. The vacuum cleaner system according to claim 1, further comprising an air tight sealing within the air path between the handheld vacuum cleaner and the stick.

3. The vacuum cleaner system according to claim 1, further comprising a release mechanism for releasing the filter from the stick.

4. The vacuum cleaner system according to claim 1, wherein the filter comprises a pleated filter media.

5. The vacuum cleaner system according to claim 1, wherein the at least one filter comprises a first filter in the air path, and a second filter covering the second air outlet.

* * * * *